US008534015B2

(12) United States Patent
Bull

(10) Patent No.: US 8,534,015 B2
(45) Date of Patent: Sep. 17, 2013

(54) REINFORCEMENT FOR CONCRETE ELEMENTS AND SYSTEM AND METHOD FOR PRODUCING REINFORCED CONCRETE ELEMENTS

(75) Inventor: Anders Henrik Bull, Asker (NO)

(73) Assignee: Reforcetech AS, Asker (NO)

( * ) Notice: Subject to any disclaimer, the term of this patent is extended or adjusted under 35 U.S.C. 154(b) by 312 days.

(21) Appl. No.: 12/092,648

(22) PCT Filed: Nov. 2, 2006

(86) PCT No.: PCT/NO2006/000395

§ 371 (c)(1),
(2), (4) Date: Jun. 25, 2008

(87) PCT Pub. No.: WO2007/053038

PCT Pub. Date: May 10, 2007

(65) Prior Publication Data

US 2008/0263989 A1 Oct. 30, 2008

(30) Foreign Application Priority Data

Nov. 4, 2005 (NO) ..... 20055188

(51) Int. Cl.
*E04C 5/08* (2006.01)
*E04C 5/00* (2006.01)

(52) U.S. Cl.
USPC ..... 52/223.6; 52/223.14; 52/659

(58) Field of Classification Search
USPC ..... 52/223.14, 223.13, 223.4, 223.6, 52/223.7, 600, 222, 223.1, 223.8, 223.9, 52/223.11, 231, 291, 414, 649.1, 659
See application file for complete search history.

(56) References Cited

U.S. PATENT DOCUMENTS

| | | | | |
|---|---|---|---|---|
| 875,804 | A * | 1/1908 | Graham | 52/240 |
| 1,065,321 | A * | 6/1913 | Thomson | 52/659 |
| 1,236,387 | A * | 8/1917 | Moore | 52/583.1 |
| 1,538,293 | A * | 5/1925 | Loyeau | 52/600 |
| 2,035,662 | A * | 3/1936 | Maney | 52/223.4 |
| 2,483,175 | A * | 9/1949 | Billner | 264/101 |
| 2,593,022 | A * | 4/1952 | Grivel et al. | 52/714 |
| 2,596,495 | A * | 5/1952 | Macerata | 264/228 |
| 3,616,589 | A * | 11/1971 | Sherard | 2/659 |
| 5,487,251 | A * | 1/1996 | Tolliver et al. | 52/600 |
| 5,768,847 | A * | 6/1998 | Policelli | 52/649.1 |
| 6,470,640 | B2 * | 10/2002 | Ytterberg | 52/414 |

(Continued)

FOREIGN PATENT DOCUMENTS

| | | | |
|---|---|---|---|
| GB | 1 388 412 | | 3/1975 |
| JP | 03055346 | A * | 3/1991 |

(Continued)

*Primary Examiner* — Ryan Kwiecinski
(74) *Attorney, Agent, or Firm* — Foley & Lardner LLP

(57) ABSTRACT

A reinforcement for concrete elements, comprising at least one elongated string formed of a smaller number of single fiber filaments which, when embedded in a matrix, form a fiber string, the exterior surface of which being coated with a particle shaped material, such as for example sand. The reinforcement comprises at least one or more loops, formed by repeatedly winding of said fiber string and that said loop(s) preferably are closed or laid in a continuous wind, the ends of the loops or the wind function as an end anchor for the reinforcement in the concrete element. A reinforcement system based on the reinforcement is also described. In addition, a method for fabricating such reinforcement system and a method for using such reinforcement system is also described.

3 Claims, 5 Drawing Sheets

(56) References Cited

U.S. PATENT DOCUMENTS

| | | | | |
|---|---|---|---|---|
| 7,056,463 | B2 * | 6/2006 | Ohta | 264/228 |
| 7,396,496 | B2 * | 7/2008 | Bull | 264/103 |
| 2002/0040558 | A1 * | 4/2002 | Matiere | 52/319 |
| 2003/0089056 | A1 * | 5/2003 | Retterer | 52/223.8 |
| 2009/0263572 | A1 * | 10/2009 | Wheatley | 427/136 |

FOREIGN PATENT DOCUMENTS

| | | | |
|---|---|---|---|
| JP | 05327267 | A * | 12/1993 |
| JP | 11-124957 | | 5/1999 |
| WO | WO 9320296 | A1 * | 10/1993 |
| WO | WO-03/025305 | | 3/2003 |

* cited by examiner

REINFORCEMENT FOR CONCRETE ELEMENTS AND SYSTEM AND METHOD FOR PRODUCING REINFORCED CONCRETE ELEMENTS

The present invention relates to reinforcement and a reinforcement system for reinforcing concrete elements. Further, the invention relates to a method for producing such reinforcement and a method for fabricating a reinforced concrete element. The reinforcement comprises at least one elongate fibre string formed of a smaller number of single fibre filaments which together provide a fibre string. The fibre string may preferably be coated with a particle shaped material, such as sand, the sand being adhered on to the exterior surface of the string. Further, the invention relates to a method for concreting such reinforced concrete elements.

It is well known that concrete structures are reinforced using steel in such way that the loads and forces are transferred from the concrete to the reinforcement, aiming to obtain a structure where the tensional load and forces are taken by the reinforcement, while compressive loads and forces are taken by the concrete itself. Standard length of reinforcement bars is 12 meters and the thickness may vary between Ø6 mm to Ø48 mm. It is obvious that such steel dimensions represent a large weight and rigidity, making it difficult to handle and place the reinforcement in a structure. When placing the reinforcement of steel, the reinforcement bars must be pre-bent and then tied together in a shuttering, in order place the reinforcement in sections where tensile forces are expected.

Where larger lengths are to be reinforced, the reinforcement bars must overlapped each other, transferring normal stresses and tensions as shear forces through the concrete from one bar to another. Welding of the bars is also possible. Conventional steel reinforcement requires, as a general rule, a concrete coverage of at least 30 mm, while at the same time, large concentration of tensional forces are experienced in the surface edges of a concrete structure. Hence, cracks may readily appear in these areas, making it possible for water to penetrate into the concrete structure, corrosion attacking the steel reinforcement. Such attacks of corrosion increase the volume of the reinforcement beyond its original volume, producing a tensile force and possibly causing spalling.

It is well known to use products of carbon fibres as reinforcement, either embedded in concrete or glued to the surface of a concrete body.

From the applicants own WO 03/025305 A1, a method for fabricating reinforcement elements for concrete is known, the reinforcement comprising elongated, preferably continuous fibre bundles of carbon fibres, impregnated with a matrix of plastic materials, which then is cured. The fibre bundle, which comprises a very large number of single fibres, is subsequent to the impregnation and prior to curing, brought into a bath containing a particle shaped material, such as sand, which adheres to the surface of the fibre bundle without to any extent penetrating in between the various fibres. The particle shaped material is fixed to the surface during the curing process, thus forming the reinforcement element.

NO 138.157 shows a loop reinforcement for pre-stressed concrete structures, where the loop reinforcement comprises several resin impregnated glass fibre strings, the cross section area of each loop being increased by means of reinforcing strings of resin impregnated glass fibres which are closely connected to each loop.

EP 1180565 discloses a flexible reinforcement for reinforced concrete in the form of a flexible band having a high module of elasticity. The band is arranged around at lease two reinforcement bars and each end of the band is tensioned in order to form a loop around the reinforcement bars, forming a rigid connection.

It is known to construct concrete floating piers made up separate, independent pier elements, wherein pairs of pier elements are connected together at their corner areas. For this purpose a vertical recess or notch is arranged in each corner of each pier element together with horizontal ducts, extending from the recesses through the element wall and out at the end wall of the element. Horizontally arranged anchoring means extend between said recess at each element through said ducts in order to assemble and interconnect two pier elements.

Because of the recesses and the ducts, each corner is exposed to large tensile forces and loads. Hence, it is necessary to reinforce the corners and the sections surrounding the recesses heavily.

Said corner areas have proved to be vulnerable, however, and the concrete is crushed in spite of heavy reinforcement, when the pier elements are exposed to large loads and forces.

The problem to be solved is that, in addition to maintaining a high degree of tensile strength, low weight and high resistance against corrosion to ensure, good strength is maintained even at high temperatures, such as for example temperatures caused by fires of high intensity.

A further problem to be solved is to increase the production rate when producing the reinforcement as such and also for providing tailor made reinforcement solution, while reducing substantially the requirements for investments in production facilities and machinery.

A still further problem to be solved is to reduce the extent of and the time required for laying the reinforcement for those instances where more or less complicated tailor made reinforcements are required for various structures.

An object of the present invention is thus to provide a reinforcement system for concrete having improved properties, giving the structures to be cast improved strength and increased life time, and at the same time reducing the need for maintenance of the concrete structures produced.

A further object of the reinforcement system according to the invention is to prolong the structural load carrying capacity of the concrete structure if the concrete structure is exposed to a fire.

A still further object of the reinforcement system according to the invention is to provide a simple and flexible reinforcement system, making it possible to adapt and to dimension the reinforcement system to complicated structural elements.

A still further object of the reinforcement system is to provide a reinforcement which is simple to lay for the operator and eliminating at least partly heavy manual lifting activities.

The above mentioned objects are achieved by a reinforcement system and a production method as further defined in the characterizing part of the independent claims. Preferred embodiments of the invention are defined in the independent claims.

An essential element in the reinforcement system according to the invention is the use of closed reinforcement loops made of a plurality of continuous fibres, for example made of carbon or basalt, embedded in a matrix, wherein the loop is cured subsequent to formation of the loop and wherein the loop is coated by a layer of particles, such as for example sand. The loops are preferably elongated and may either be in the form of closed loops or elongated winds, arranged in longitudinal direction and corresponding loops or winds in a transverse direction. The semi-circular ends of loops or the winds are configured to function as an end anchoring the reinforcement. The effects of the loop reinforcement may also at least partly be achieved by providing a helical reinforcement. When such helical reinforcement is embedded in cured concrete, the helical reinforcement will function as a multi-axial reinforcement.

When using the reinforcement according to the invention, abrupt or sudden concentration of forces will to a much less degree appear in the region of the ends of the reinforcement. If it is necessary to "join" the reinforcement, conventional overlapping may be applied corresponding to the traditional steel reinforcement. The major difference is that the forces from one reinforcement element is transferred to the neighbouring reinforcement in that, in addition to transfer of shear strain between the reinforcement loops, a local compression zone is established in the concrete between the ends of two overlapping loops. Since concrete may resist large compressive forces, possible cracks or minute cracks in this load transfer zone will be closed by the compressive force rather than being opened up, as the case may be for conventional reinforcement. The size of such compressive forces depends on several parameters, depending inter alia on the bonding between the composite reinforcement and the surrounding concrete.

The reinforcement is made of a composite material, amongst other containing carbon fibres or basalt fibres.

The reinforcement loops according to the invention have good material properties, such as high tensile strength, low weight, and high corrosion resistance. In addition, high tensile strength is maintained even at high temperatures, such as for example during highly intensive fires.

Tests have shown that the reinforcement according to the invention is four times stronger than steel, while the weight is four times lower than steel. Consequently, substantial weight savings may be obtained when using the reinforcement according to the invention.

In addition, it should be appreciated that since the reinforcement according to the invention has a high degree of inherent resistance towards corrosion, the reinforcement may be placed close to or on the surface of the concrete element to be reinforced, thus requiring a reduced or no concrete coverage. Hence, the reinforcement may be placed where it really is needed.

The invention shall now be described in closer details, referring to the accompanying drawings, in which.

Figure 1:
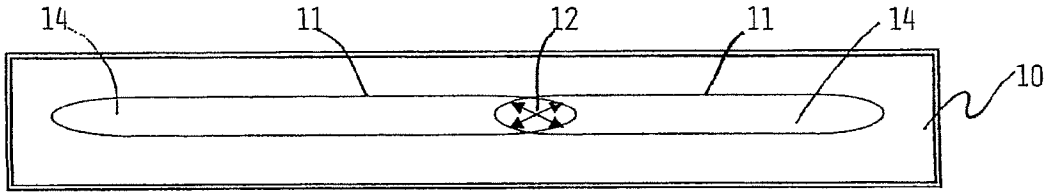
FIG. 1 shows schematically a vertical section through a reinforced concrete element, wherein two reinforcement loops according to the principle of the invention are shown.

FIG. 1 shows schematically a vertical section through a concrete element 10, schematically shown as a rectangular beam, seen from above. As indicated, the beam is schematically reinforced by means of two reinforcement loops 11. A plurality of reinforcement loops 11 may be used, but from a clarity point of view, only two reinforcement loops 11 are shown in the Figure. It should be appreciated, however, that a large number of reinforcement loops 11 may be used, dependent upon the forces and loads which the concrete element from a design point of view must be dimensioned for. The reinforcement loops 11 may be arranged in any preferred plane, including the horizontal and the vertical plane. As indicated in FIG. 1, the reinforcement loops 11 are arranged in the horizontal plane, one end of one loop overlapping the other, forming a closed cylindrical room 12 between themselves. The opposite end of each reinforcement loop 11 forms a closed semi-circle 14.

When the concrete element is subjected to tensile loads, for example as indicated by the arrows in FIG. 1, the two overlapping ends of the reinforcement loops 11, will together form the closed cylindrical room 12, exposing the concrete inside said room 12 for compression and hence, functioning as an end anchor causing a local pre-stressing compression. The ends of the loops 11 function thus as an end anchor for the reinforcement, while at the same time the straight parts of the loops 11 functioning as conventional reinforcement.

It should be appreciated that the loops 11 according to the embodiment shown may for example be formed of a small number of single fibre filaments which may be interconnected by means of a matrix in order to form a fibre string, coated with a particle shaped material on the exterior of the string. The particle shaped material may for example be sand.

The strings 11 may for example have a height of 1-5 cm, while the thickness may for example be 1-2 mm. The elongated loop 11 may be formed by repeatedly winding said fibre string in order to form the closed loops 11.

The loops 11 may be configured in such way that their ends for example may have the form of semi-circles or semi-ovals.

Figure 2:
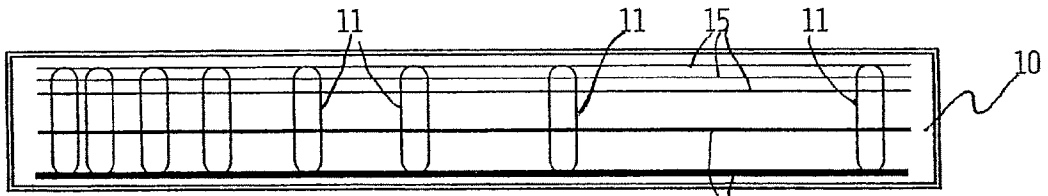
FIG. 2 shows a view of one embodiment of a reinforcement net formed of a plurality of closed reinforcement loops.

FIG. 2 shows an alternative embodiment of reinforcement according to the invention. Also this embodiment is shown in relation to a concrete slab 10, and like the embodiment shown in FIG. 1, only one layer of reinforcement is shown. The embodiment comprises a plurality of closed loops 11 arranged in succession after each other, interconnected at least at their ends by means of elongated fibre strings 15, thus forming a reinforcement net or a reinforcement mat. Said elongated fibre strings 15 may either be in the form of straight strings, or in the form of loops positioned perpendicular with respect to the loops 11. Such net or mat may for example be used as reinforcement for concrete floor, concrete walls or the like.

A reinforcement embodiment as shown in the Figures may for example be used as reinforcement for concrete columns.

Figure 3:
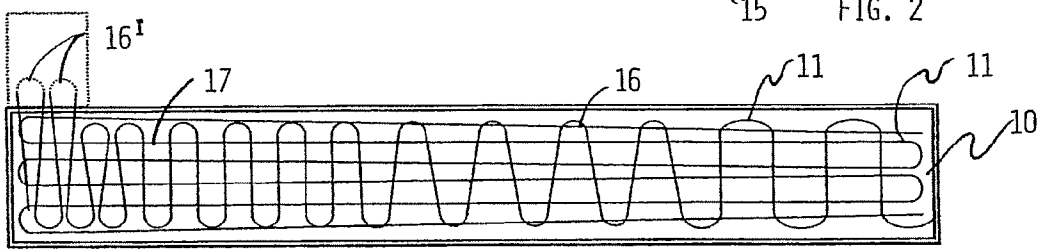
FIG. 3 shows an alternative embodiment of a reinforcement net formed of a plurality of continuous reinforcement loops arranged both lengthwise and in a transverse direction.

FIG. 3 shows a third embodiment of a reinforcement mat, where the loops 11 are in the form of transverse winds 16 which are interconnected by a plurality of elongated winds 17. The fibre strings forming the winds 16,17 may for example have dimensions as specified above in respect to FIG. 1.

As indicated in FIG. 3, two of the loops 16' may be laid so that their end is extending out of the concrete element 10. The loops 16' may for example be used for attaching the concrete element 10 to an adjacent concrete element (not shown). In such case, the loops may for example be placed in a corresponding recess in the adjacent concrete element, whereupon the two concrete elements may be inter-concreted in situ. It should be appreciated that the number of loops 16' which are extending out the concrete element 10 may be one or several without deviating from the inventive concept.

Figure 4:
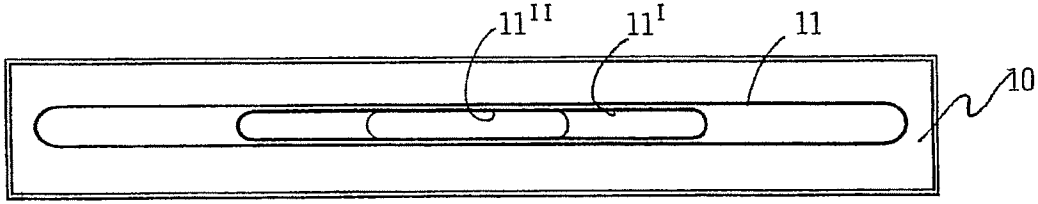
FIG. 4 shows a plurality of coaxially and concentrically arranged reinforcement loops according to the invention.

FIG. 4 shows schematically a fourth embodiment of the invention, where the reinforcement loops 11-11" are placed concentric with respect to each other. The reinforcement loop 11 has the longest length, the reinforcement loop 11' being somewhat shorter, while the reinforcement loop 11" has the shortest length. According to such embodiment, it is possible, by means of the loops 11-11", to place the major part of the reinforcement in sections where the need of a reinforcement cross-section is largest. The concrete element shown in FIG. 4 may for example be a beam supported at each end. According to this solution, the bending moments may be largest at the middle portion of the beam and consequently, this portion requires the heaviest reinforcement. Such embodiment results in the most optimal use of the material volumes.

Figure 5:
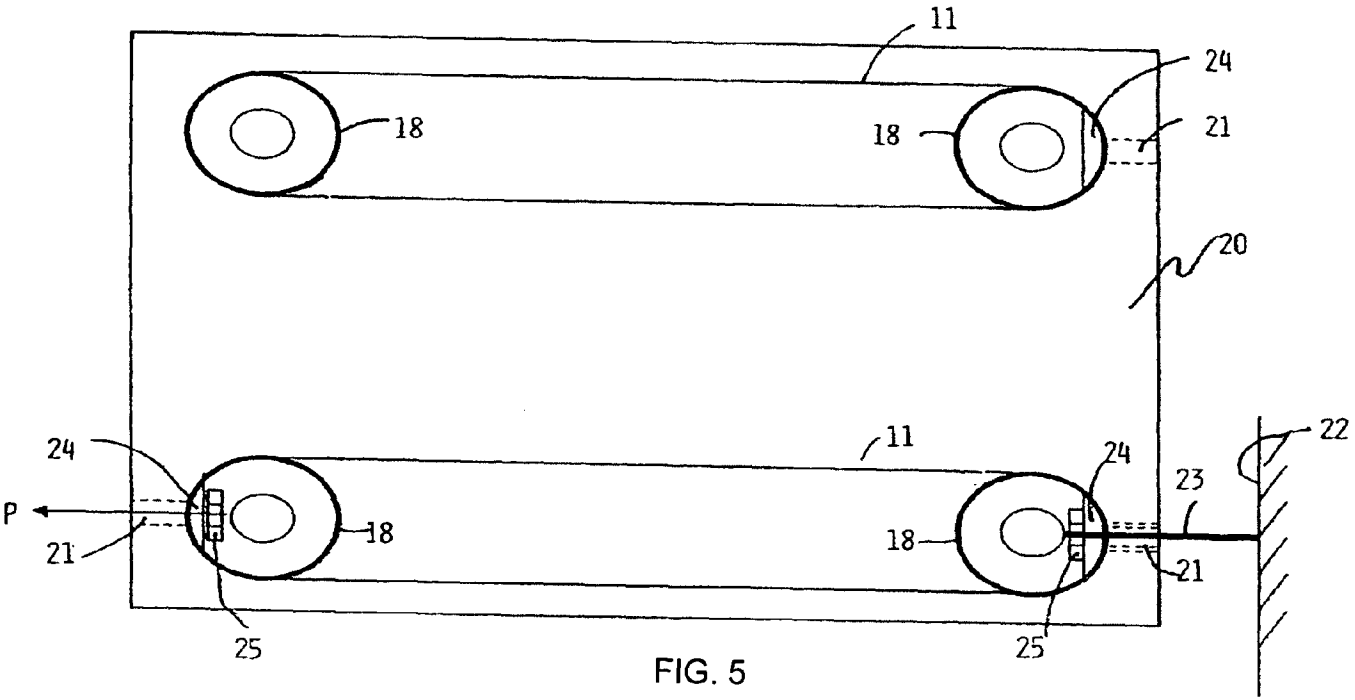
FIG. 5 shows schematically a horizontal section through a pontoon, wherein reinforcement loops according to the invention are used for reinforcing the pontoon.
Figure 6:
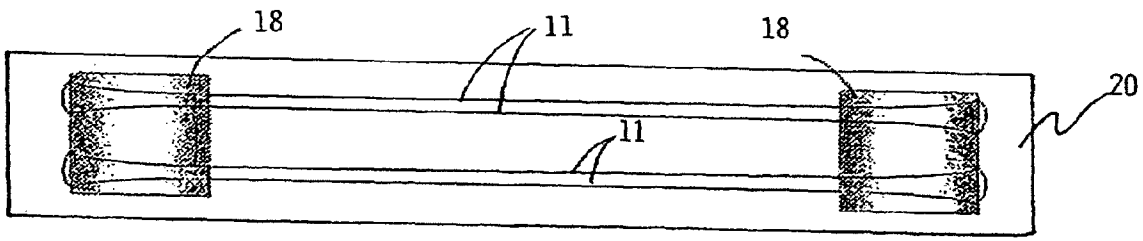
FIG. 6 shows schematically a vertical section through the reinforcement used in connection with the pontoon unit shown in FIG. 5.

FIGS. 5 and 6 show an example of the use of the reinforcement loops 11 according to the invention, used in relation to one possible embodiment, where each end of the loops 11 are wound around a cylindrical tube 18. According to the embodiment shown in FIGS. 5 and 6, the concrete structure forms a part of a floating pier 20 of the type comprising several elements which are tied together, intended to form for example a long, modularized floating pier or the like. FIG. 5 shows a horizontal section through the floating element 20, while FIG. 6 shows a part where only the cylindrical tubes 18 and the reinforcement loops are shown. According to this embodiment the cylindrical tubes 18 are formed of cylindrical steel tubes, positioned at the corners of the floating body 20. It should be appreciated, however, that the cylinders 18 also may be made of materials other than steel, such as other types of metal or plastic materials. As for the previously shown embodiments, the reinforcement loops 11 are wound around pairs of adjacent cylindrical tubes 18, both in longitudinal direction and in transverse direction of the floating body 20. FIGS. 5 and 6 show only those loops 11 which are wound in the longitudinal direction of the floating body 20.

In order to facilitate interconnection of two adjacent floating bodies 20, or tying an element to a shore anchor point 22, each of the corners, in relation to the cylindrical bodies 18, is provided with recesses 21. Correspondingly, the cylindrical bodies 18 are provided with an opening and a flange 24 provided with a hole, forming a supporting surface for a tie rod 23 or the like, for inter-connecting or tying together one floating body with another floating body or to the anchor point on shore. The tie rod 23 may be attached inside the cylindrical body 18 by means of an anchor plate 25 so that the tie rod may be tightened up. As shown in FIG. 5, only one such tie rod 23 is shown. It should be appreciated, however, that that such tie rod 23 may be employed in respect to each of the cylindrical bodies 18 in order to fix the floating body to shore anchors 22 or for tying two adjacent neighbouring floating bodies 20 together. The arrow P indicates the direction of the pulling force, acting on the floating body 20 at the corner.

It should be appreciated that the attachment and the tie-in of the tie rod may be done in any way known to a person skilled in the art.

Figure 7:
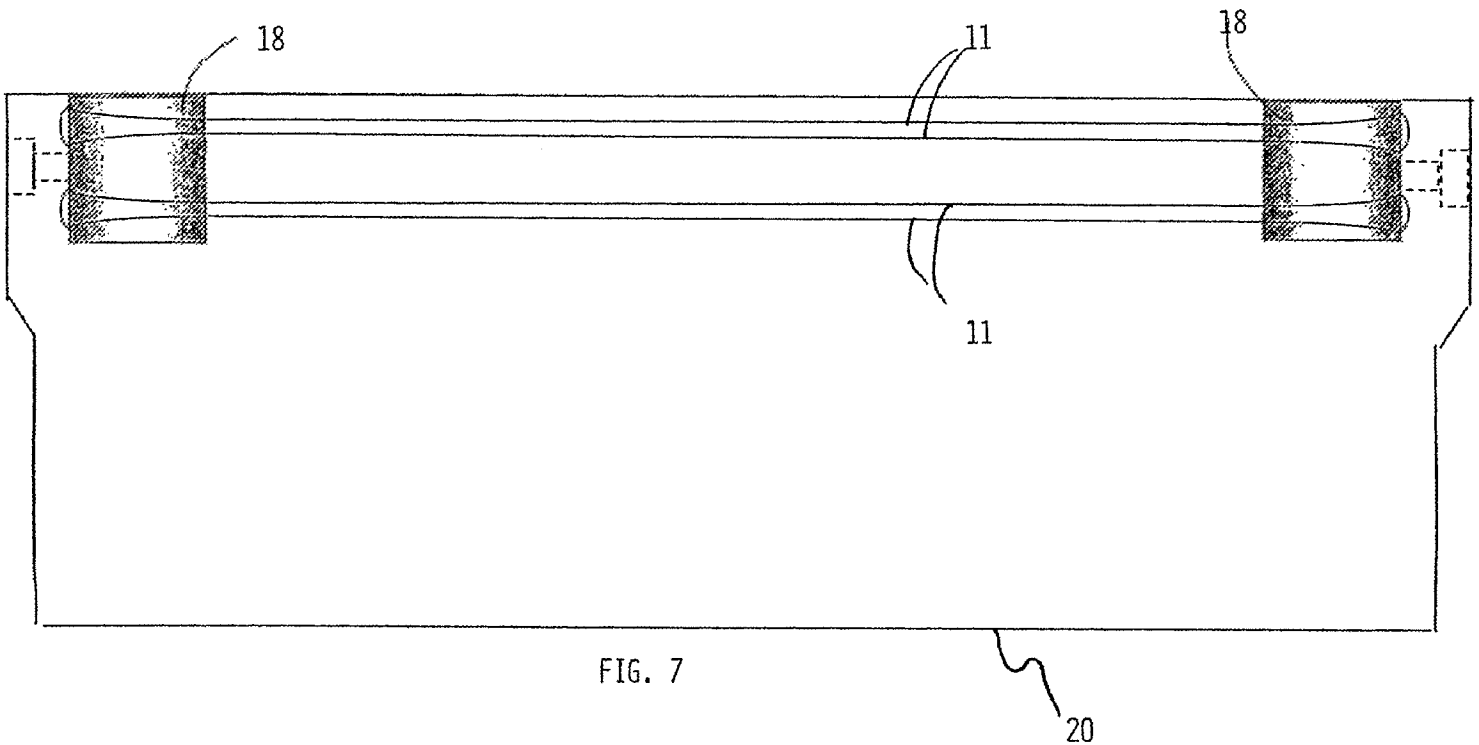
FIG. 7 shows schematically a vertical section through the pontoon unit shown in FIG. 5.

FIG. 7 shows a vertical section through the floating body 20 shown in FIG. 5, where the reinforcement loops 11 and two cylindrical bodies 18 are shown. As shown, the reinforcement, together with the cylindrical bodies, are arranged in the upper half of the buoyancy body.

Figure 8:
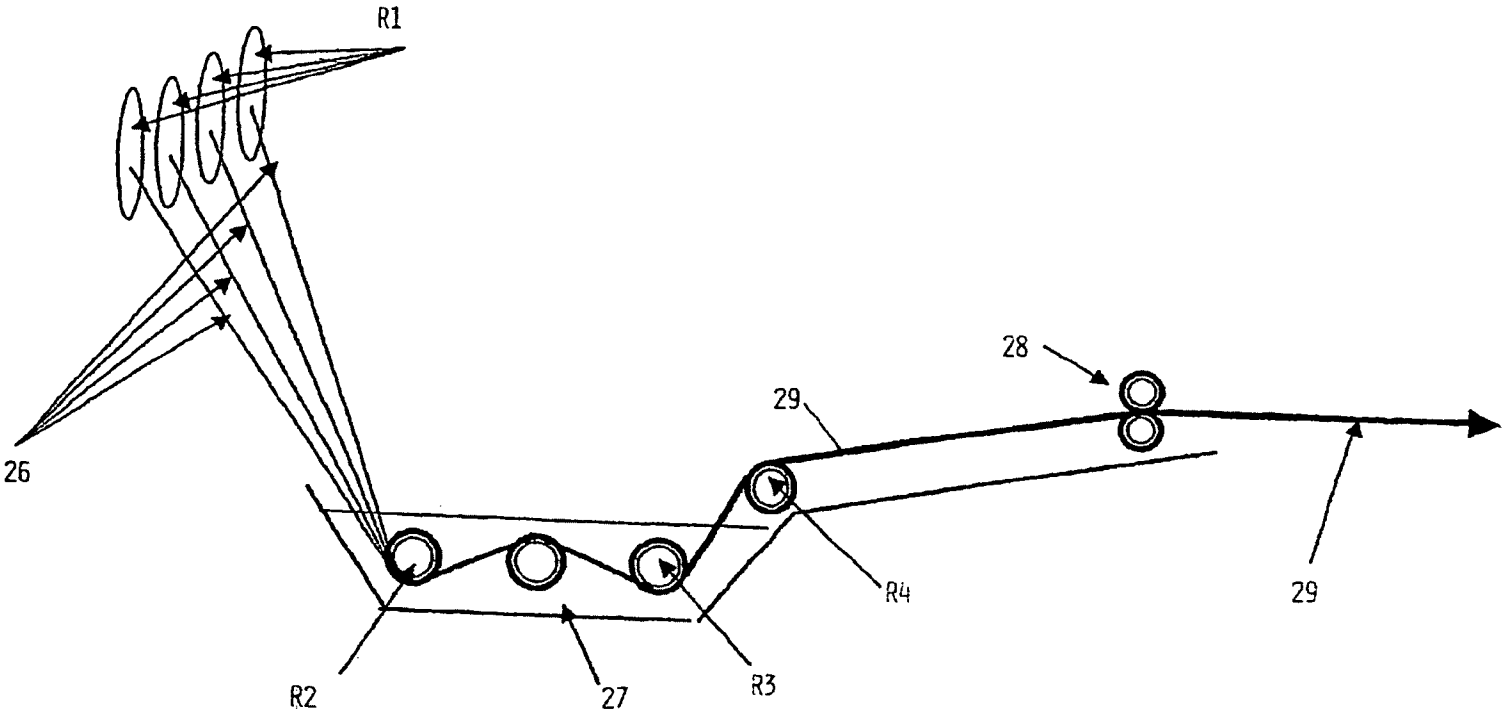
FIG. 8 shows schematically the first steps in fabrication of a fibre bundle by means of a plastic material.
Figures 9, 10:
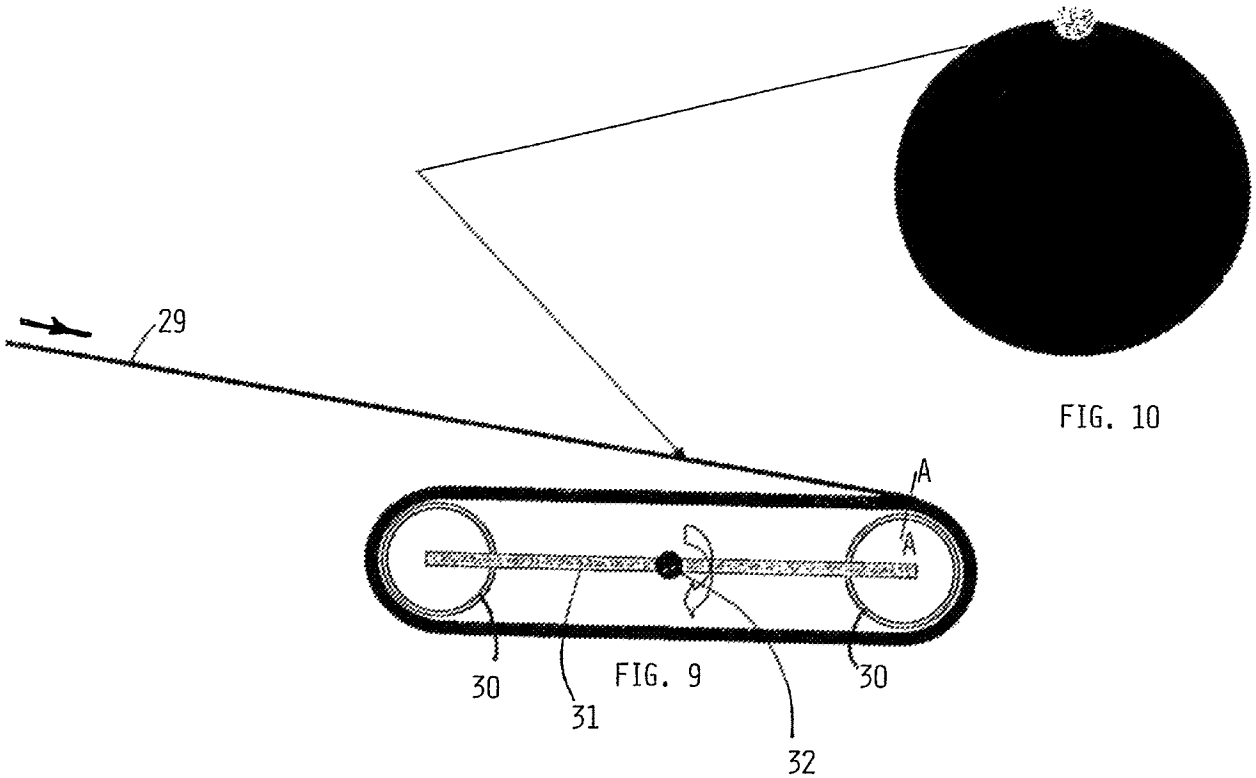
FIG. 9 shows how a loop according to the invention may be fabricated.
FIG. 10 shows a vertical section through the reinforcement loop 11, seen along the line A-A in FIG. 9.

FIGS. 8 and 9 shows schematically a possible way to fabricate the fibres forming part of the reinforcement and showing a way to fabricate the loops. In the first part of the production line, as illustrated in FIG. 8, a larger number of continuous single fibres or filaments 26 are drawn or pulled from a corresponding number of filament or fibre spools or reels R1. The fibres 26 are firstly collected and fed down into a bath of a floating plastic materials or a matrix 27, in order to become impregnated. The collected fibre bundle 29 may preferably be pulled by means of driven rolls, such as the ones identified by the reference numbers R2 and R3. The impregnated fibre bundle is the pulled over a roller R4, pulling the bundle out of the bath, possibly by pre-tensioning the bundle, which may be obtained by a pulling means 28 comprising a pair of rollers. These rollers 28 may also function as a means for squeezing out the possible surplus of uncured plastic materials or matrix which the fibre bundle is impregnated with. From the rollers 28 the impregnated fibre bundle 29 is pull for example for winding around a drum shaped body as indicated in FIG. 9.

FIG. 9 shows an impregnated, but not yet cured fibre bundle 29 which is wound around two elongated cylindrical drums 30. The drums 30 may be interconnected by means of one or more arms 31 which at their middle point may be supported by a shaft 32 which is parallel with the axis of the drum. By rotating the interconnected drums 30 around its axis 32, impregnated but yet not cured fibre bundles 29 are wound onto each other, forming a loop shaped reinforcement 11.

FIG. 10 shows a section through the fibre bundle 29, seen along the line A-A in FIG. 9. The fibre bundle 29 is wound on the drum body 30,31,32, so that the fibre loop 11 is given a more or less circular cross section, as shown in FIG. 10. Alternatively, the fibre bundle 29 may be wound onto the drum so that the cross section becomes more or less oval.

When winding of a loop 11 is completed to the desired shape and dimension, the exterior of the loop may be coated with a particle shaped material, such as sand, and thereupon the loop is cured in a suitable manner. It should be appreciated that the particle shaped material shall adhere only to the external surface of the bundle, so that the fibres inside the bundle 29 are not exposed to sharp particle surfaces. The purpose of the particle shaped material coated on the exterior of the loops 11 is to secure proper bonding between the concrete and the fibre bundle when concreted.

In case the reinforcement shall have a different shape, such as for example elongated loops which wind to and fro, then the method for manufacturing the impregnated, but yet not cured fibre bundle 29 will correspond to the method described in respect to FIG. 9. The fibre bundle 29 is then wound around a specifically developed template, giving the required reinforcement shape, whereupon a particle shaped material is applied to the uncured surface of the fibre bundle 29 prior to curing in any suitable way.

The fibre material used in the fibre bundle 29 may according to the present invention be formed for example of a material with a very high melting point, for example exceeding 1000° C., while the impregnating material or the matrix may for example be made of a plastic material, such as thermo plastics. Carbon or basalt may be a suitable material for the fibre filaments 26.

A substantial advantage of using fibre materials of this type is that a major part of the reinforcing effect will be maintained even if the concrete structure is exposed to very temperatures, for example caused by a fire. Even if the impregnating material/matrix is melted or burned away, which may occur at a temperature around 200° C., the continuous fibre bundle will still be positioned inside its "concrete corridor", more or less free of oxygen. Since oxygen is not present, materials such as carbon and basalt or similar type of materials, may withstand very high temperatures, such as 1000° C. or more.

If the reinforcement loop is made of a thick fibre bundle, wound few times around the loop, such a fibre bundle will be pulled out of its "corridor" after the fire. If the reinforcement loop according to the present invention is made of thinner fibre bundles, wound around the loop a very large number of times, the loop will able to withstand substantial tension even when the impregnating material/matrix has evaporated away.

Unless otherwise explicitly specified in the text, it should be appreciated that the term loop also shall include winds or helixes, formed of the fibre strings or bundles according to the invention.

Although cylindrical bodies are described above, it should be appreciated that the term "cylindrical bodies" includes a body where the surfaces, around which the fibre reinforcement is wound, are curved. The part of the cylindrical body which is not intended to be in contact with the fibre reinforcement may have any suitable shape. It should further be appreciated that the cylindrical body either may be solid and compact or may be hollow without deviating from the inventive idea.

Further, it should be appreciated that that the fibre loops may range from thick and long to short and thin. In combination or separate, the long and thick loops may take the tensile forces, while use of a large number of short loops may prevent, or at least reduce, spalling of the concrete caused by quick increase in temperature in case of fires. This may be due to the fact that a single loop will function, even if the heat from the fire has carbonized or evaporated away the matrix.

Further, its should be appreciated that although the loops are oval, they may still have a more or less rounded shape.

Small loops according to the invention are suitable for use in respect to gunite, and the loops may also prevent formation of cracking and minute cracks in the concrete.

The invention claimed is:

1. A reinforced concrete structure comprising a reinforcement embedded within cured concrete, wherein the reinforcement is in the form of primary closed loops disposed in a given direction with a first loop end followed by a second loop end in the given direction, each primary closed loop embedded within the cured concrete comprising at least two elongated string sections, parallel and distanced apart from each other, ends of the at least two elongated string sections being interconnected by a curved arced transition forming the first and second loop ends, the first and second loop ends completely embedded within the cured concrete and imposing compressive forces on the surrounding concrete as the concrete structure is subjected to external loads and forces, and wherein the primary closed loops are positioned to run in the given direction substantially end-to-end but with an overlap of the second loop end of a first one of the primary closed loops overlapping with the first loop end of a second one of the primary loops to form a closed internal secondary loop exposed to compressive forces from the primary closed loops caused by tensional forces acting in the at least two elongated string sections as the concrete structure is subjected to the external forces and loads, and each of the at least two elongated string sections formed of a number of single fiber filaments of carbon or basalt, which is wound to a continuous string by repeated windings of the single fiber filaments and embedded in a matrix, thereby providing a composite fiber string.

2. A reinforced concrete structure comprising a reinforcement embedded within cured concrete, wherein the reinforcement is in the form of primary closed loops disposed in a given direction with a first loop end followed by a second loop end in the given direction, each primary closed loop embedded within the cured concrete and comprising at least two elongated string sections, parallel and distanced apart from each other, ends of the elongated string sections being interconnected by a curved arced transition forming the first and second loops ends, the first and second loop ends completely embedded within the cured concrete and imposing compressive forces on the surrounding concrete as the concrete structure is subjected to external loads and forces, and wherein the primary closed loops run in the given direction and are in the same plane, with the primary closed loops overlapping with each other to form a closed internal secondary loop exposed to compressive forces from the primary closed loops caused by tensional forces acting in the elongated string sections as the concrete structure is subjected to the external forces and loads, and each of the at least two elongated string sections formed of a number of single fiber filaments of carbon or basalt, which is wound to a continuous string by repeated windings of the single fiber filaments and embedded in a matrix, thereby providing a composite fiber string.

3. A reinforced concrete structure comprising a reinforcement embedded within cured concrete, wherein the reinforcement is in the form of a plurality of slings disposed in a given direction with a first sling end followed by a second sling end in the given direction, each of the plurality of slings embedded within the cured concrete and comprising at least two elongated string sections, parallel and distanced apart from each other, ends of the elongated string sections being interconnected by a curved arced transition forming the first and second sling ends, the first and second sling ends completely embedded within the cured concrete and imposing compressive forces on the surrounding concrete as the concrete structure is subjected to external loads and forces, and wherein the plurality of slings are positioned to run in the given direction substantially end-to-end but with an overlap of the second sling end of a first sling of the plurality of slings overlapping with the first sling end of a second sling of the plurality of slings, to form a closed internal loop exposed to compressive forces from the first and second slings of the plurality of slings caused by tensional forces acting in the elongated string sections as the concrete structure is subjected to the external forces and loads, and each of the at least two elongated string sections formed of a number of single fiber filaments of carbon, which is wound to a continuous string by repeated windings of the single fiber filaments and embedded in a matrix, thereby providing a composite fiber string.

* * * * *

UNITED STATES PATENT AND TRADEMARK OFFICE

CERTIFICATE OF CORRECTION

PATENT NO. : 8,534,015 B2
APPLICATION NO. : 12/092648
DATED : September 17, 2013
INVENTOR(S) : Bull It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 474 days.

Signed and Sealed this
Tenth Day of February, 2015

Michelle K. Lee

Michelle K. Lee
*Deputy Director of the United States Patent and Trademark Office*